US006783086B1

(12) United States Patent
Boecking

(10) Patent No.: US 6,783,086 B1
(45) Date of Patent: Aug. 31, 2004

(54) TWO-STAGE MAGNET VALVE OF COMPACT DESIGN FOR AN INJECTOR OF AN INJECTION SYSTEM FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 333 days.

(21) Appl. No.: 09/807,120

(22) PCT Filed: Aug. 2, 2000

(86) PCT No.: PCT/DE00/02578

§ 371 (c)(1),
(2), (4) Date: Jul. 27, 2001

(87) PCT Pub. No.: WO01/11221

PCT Pub. Date: Feb. 15, 2001

(30) Foreign Application Priority Data

Aug. 9, 1999 (DE) ..... 199 37 559

(51) Int. Cl.[7] ..... B05B 1/30

(52) U.S. Cl. ..... 239/585.1; 239/96; 239/533.3; 239/533.8; 251/129.16

(58) Field of Search ..... 239/88, 96, 585.1, 239/533.3, 533.8; 251/129.02, 129.16, 129.18

(56) References Cited

U.S. PATENT DOCUMENTS 4,690,374 A * 9/1987 Polach et al. ..... 251/129.02
5,605,289 A * 2/1997 Maley et al. ..... 239/585.1
5,820,101 A * 10/1998 Ricco ..... 239/585.1

FOREIGN PATENT DOCUMENTS

| | | |
|---|---|---|
| DE | 1 97 08 104 A1 | 9/1998 |
| DE | 1 97 41 850 A1 | 3/1999 |
| EP | 0 829 641 A2 | 3/1998 |
| EP | 0 907 018 A2 | 4/1999 |
| EP | 0 916 843 A1 | 5/1999 |

* cited by examiner

*Primary Examiner*—Steven J. Ganey
(74) *Attorney, Agent, or Firm*—Ronald E. Greigg

(57) ABSTRACT

A two-stage magnet valve for injectors of injection systems for internal combustion engines is proposed, which is very compact and simple in design, because an in-line connection of the first valve spring and a second valve spring can be avoided.

17 Claims, 3 Drawing Sheets

TWO-STAGE MAGNET VALVE OF COMPACT DESIGN FOR AN INJECTOR OF AN INJECTION SYSTEM FOR INTERNAL COMBUSTION ENGINES

CROSS-REFERENCE TO RELATED APPLICATIONS

This application is a 35 USC 371 application of PCT/DE 00/02578 filed on Aug. 2, 2000.

BACKGROUND OF THE INVENTION

1. Field of the Invention

The invention is based on an injector for an injection system for internal combustion engines, having a magnet valve which controls the outflow of fuel from a valve control chamber through an outflow conduit, in which the magnet valve has means for closing the outflow conduit, an armature that is actuatable by an electromagnet and is operatively connected to the means for closing the outflow conduit, a first valve spring and a second valve spring and a first stroke stop.

2. Description of the Prior Art

Two-stage magnet valves for injectors of injection systems are known. With the first opening stage of the magnet valve, it is intended that the nozzle needle of the injection nozzle open slowly, so that the precise metering of small pre-injection quantities is made easier. The second opening stage is used for the main injection. A high opening speed of the nozzle needle is desired.

In a known version of a two-stage magnet valve, the armature of the magnet valve can be urged counter to the opening direction of the magnet valve via two compression springs connected in line. Until a first stroke stop is reached, only a first compression spring acts on the armature counter to the opening direction of the valve; once the armature has passed the first stroke stop, a second compression spring with the same direction of operation additionally acts upon the armature.

A disadvantage of this embodiment is that because of the in-line connection, the structural length of the magnet valve is great. This is problematic especially in modern, compactly designed engines and modern motor vehicles, since the available installation space is as a rule limited. Furthermore, the in-line connection of two springs with the aid of an intermediate part means that the natural frequencies of the magnet valve are relatively low, which can have adverse effects in the operating performance.

A two-stage valve of an injector, which valve is actuated by a piezoelectric actuator, is known from German Patent Disclosure DE-OS 1974 1850. In this magnet valve, once again two valve springs are connected in line, and an intermediate ring is disposed between the two valve springs. This valve again has the disadvantages discussed above.

OBJECTS AND SUMMARY OF THE INVENTION

The object of the invention is to furnish a two-stage magnet valve for an injector that is compact in design and whose operating performance is good at the most various frequencies.

This object is attained in accordance with the invention by an injector for an injection system for internal combustion engines, having a magnet valve which controls the outflow of fuel from a valve control chamber through an outflow conduit, in which the magnet valve has means for closing the outflow conduit, an armature that is actuatable by an electromagnet and is operatively connected to the means for closing the outflow conduit, a first valve spring and a second valve spring and a first stroke stop; in the invention, the first valve spring urges the armature in the closing direction with a greater spring force, and from the closing position of the magnet valve until the first stroke stop is reached, the second valve spring urges the armature in the opening direction with a lesser spring force.

Because of the different directions of action of the first and second valve springs, an especially compact design of the magnet valve is achieved:

For the case where both the first and the second valve springs are compression or tension springs, one valve spring can be disposed on each side of the armature, and thus the length of the valve springs is not added to the structural length of the armature in contributing to the total structural length of the magnet valve. In other words, at least one valve spring can be disposed parallel to and in particular concentrically with the armature, so that the total structural length of the magnet valve is reduced accordingly.

For the case where the first valve spring is a compression spring and the second valve spring is a tension spring, it is even possible for both valve springs to be disposed parallel to and in particular concentrically with the armature, so that the total structural length of the magnet valve is reduced still further.

In addition, in the disposition of the valve springs according to the invention, connecting them in line is avoided, which has a favorable effect on the resonance behavior of the magnet valve.

In a variant of the invention, it is provided that the first valve spring is a compression spring fastened between a housing of the injector and the end of the armature remote from the means for closing the outflow conduit; that the Is second valve spring is a compression spring fastened between the housing of the injector and the end of the armature toward the means for closing the outflow conduit, so that a simple construction is achieved simultaneously with only little space requirement on the part of the magnet valve. The small space requirement is due among other factors to the disposition of the second valve spring between means for closing the outflow conduit and the armature. Also in this version, the metering of small pre-injection quantities is made possible despite a high opening speed of the nozzle needle in the main injection.

In another variant of the invention, it is provided that the second valve spring acts upon the armature via a displaceable intermediate ring, and that the travel of the intermediate ring is limited by the first stroke stop, so that the first stroke stop can be defined simply and precisely.

In one version of the invention, the travel of the armature is limited by a second stroke stop, so that the opening of the magnet valve in the main injection is defined with high repeatability.

In a further version of the invention, the means for closing the outflow conduit are operatively connected to the armature via a thrust rod, so that a spatial separation between the means for closing the outflow conduit and the armature is provided. Moreover, this affords more space for the second valve spring.

In a variant of the invention, it is provided that the second valve spring and/or the intermediate ring is disposed concentrically with the thrust rod, so that the space required by the magnet valve of the invention decreases further.

In a supplement to the invention, it is provided that the means for closing the outflow conduit are a ball and a ball seat in the housing, or that a valve head, disposed on the end of the thrust rod remote from the armature, and a complementary valve seat in the housing, so that in a simple way reliable sealing of the outflow conduit is accomplished.

One version of the invention provides that the injection system is a common rail injection system, so that the advantages according to the invention are extended to these injection systems as well.

BRIEF DESCRIPTION OF THE DRAWINGS

Further advantages and advantageous features of the invention can be learned from the ensuing description, the drawing and the claims. Taken with the drawings, in which:

DESCRIPTION OF THE PRIOR ART

Figure 1:
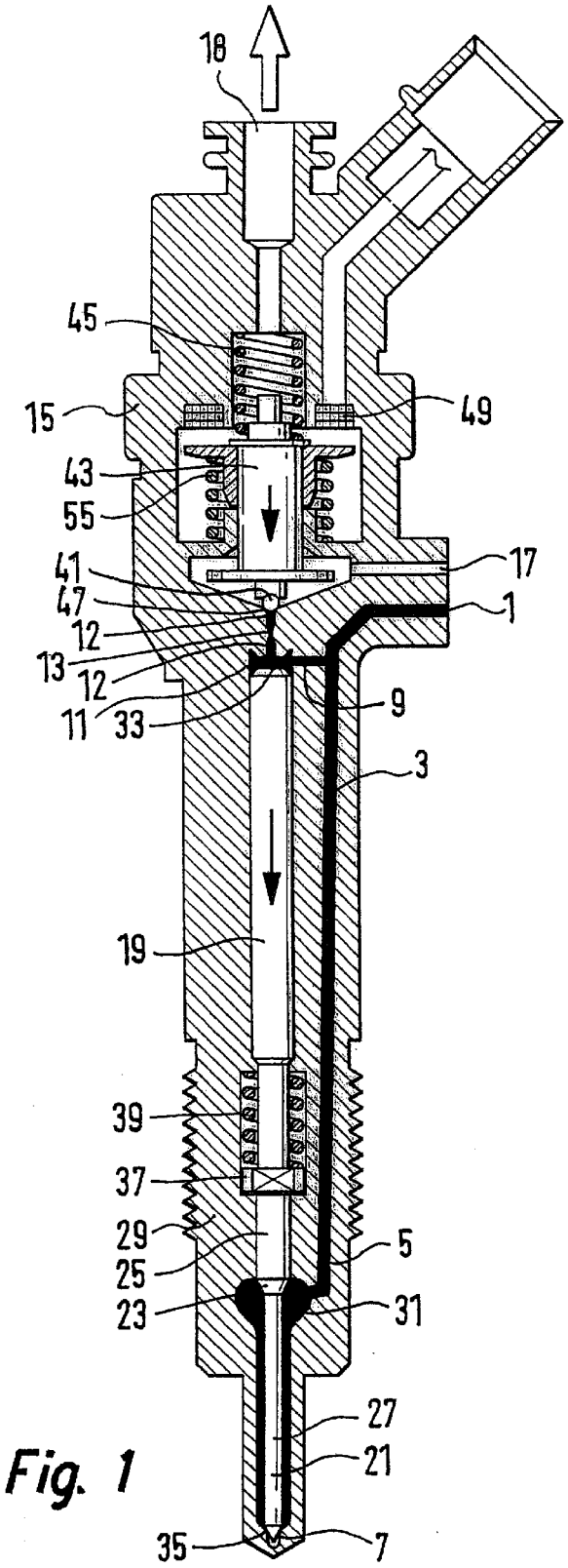
FIG. 1, is a schematic illustration of an injector of the invention.

In FIG. 1, an injector is shown schematically. Via a high-pressure connection 1, fuel 3 is carried via an inlet conduit 5 to an injection nozzle 7 and via an inlet throttle 9 into a valve control chamber 11. The valve control chamber 11 communicates with a fuel return 17 via an outflow conduit 12 and an outflow throttle 13, which can be opened by a magnet valve 15. Leakage from the magnet valve 15 is carried away through the leakage outlet 18. The fuel 3 is shown in FIG. 1 as a black area.

The valve control chamber 11 is defined by a valve piston 19. The valve piston 19 is adjoined by a nozzle needle 21, which prevents the fuel 3 that is under pressure from flowing into the combustion chamber, not shown, between injections. The nozzle needle 21 has a cross-sectional change 23 from a larger diameter 25 to a smaller diameter 27. With its larger diameter 25, the nozzle needle 21 is guided in a housing 29. The cross-sectional change 23 defines a pressure chamber 31 of the injection nozzle 7.

When the outflow throttle 13 is closed, the hydraulic force acting on one end face 33 of the valve piston 19 is greater than the hydraulic force acting on the cross-sectional change 23, because the end face 33 of the valve piston 19 is larger than the annular face of the cross-sectional change 23. Consequently, the nozzle needle 21 is pressed into a nozzle needle seat 35 and seals the inlet conduit 5 off from the combustion chamber, not shown.

If the high-pressure pump, not shown, of the fuel injection system is not driven because the engine is stopped, then a nozzle spring 39, acting on a shoulder 37 of the nozzle needle 21, closes the injection nozzle 7 or injector.

If the outflow throttle 13 of the magnet valve 15 is opened, the pressure in the valve control chamber 11 drops, and thus the hydraulic force acting on an end face 33 of the valve piston 19 decreases as well. As soon as this hydraulic force is less than the hydraulic force acting on the cross-sectional change 23, the nozzle needle 21 opens, so that the fuel 3 can pass through the injection ports, not shown, to reach the combustion chamber. This indirect triggering of the nozzle needle 21 via a hydraulic force booster system is necessary because the forces required for fast opening of the nozzle needle 21 cannot be generated directly by the magnet valve 15. The so-called "control quantity" additionally needed besides the fuel quantity injected into the combustion chamber reaches the fuel return 17 via the inlet throttle 9, the valve control chamber 11, and the outflow throttle 13.

In addition to the control quantity, leakage also occurs at the nozzle needle guide and the valve piston guide. The control and leakage quantities can amount to up to 50 $mm^3$ per stroke. They are returned to the fuel tank, not shown, via the fuel return 17.

Figure 2:
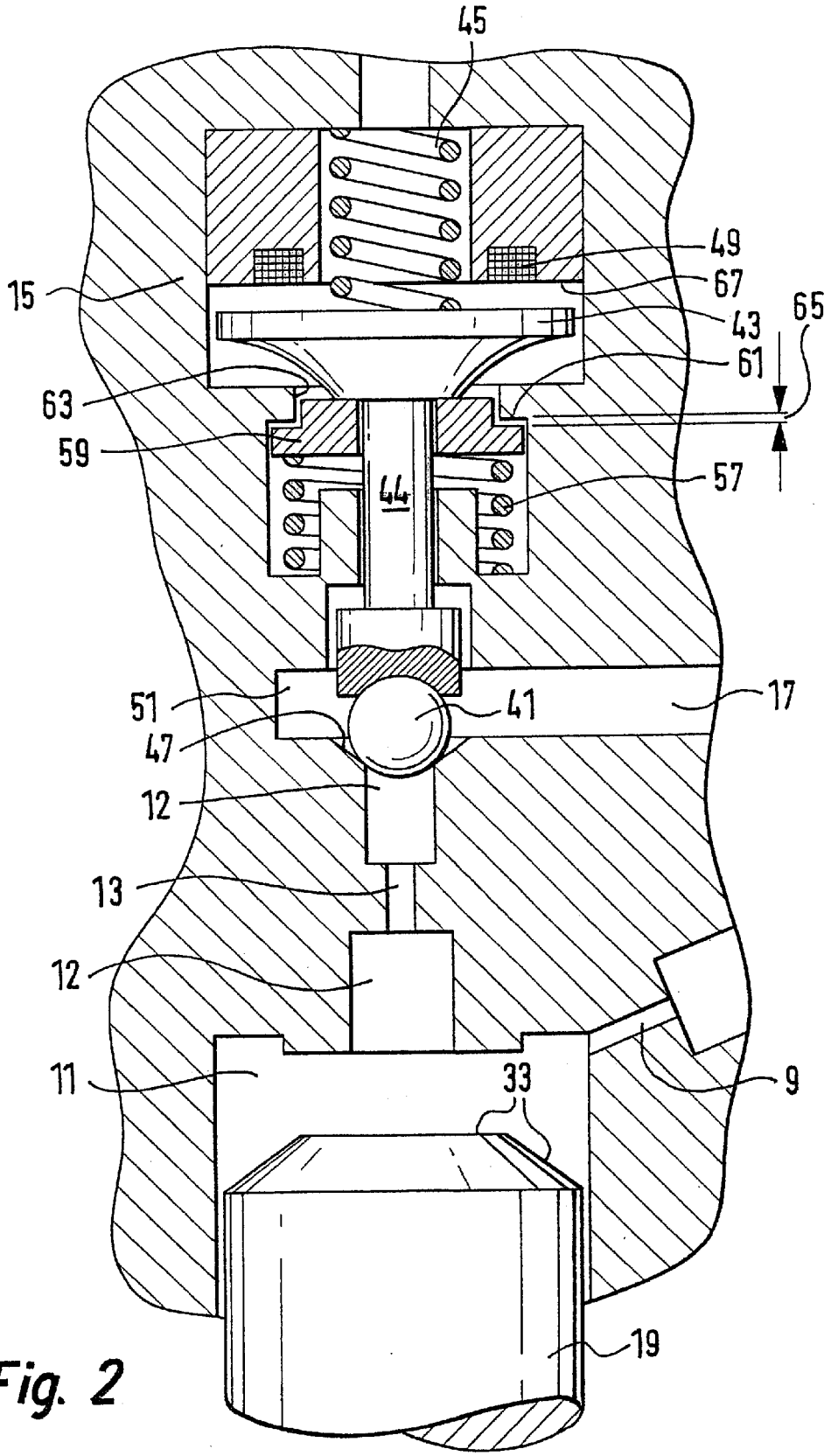
FIG. 2 is a fragmentary sectional view showing a two-stage magnet valve of the invention.

In FIG. 2, a magnet valve 15 according to the invention is shown. Between injections, the outflow throttle 13 is closed by a ball 41 of the magnet valve 15. This takes place indirectly via an armature 43, a thrust rod 44 connected to the armature, and a first valve spring 45, because the ball 41 is pressed into a ball seat 47 of the housing 29. Between the ball seat 47 and the armature 43, a second valve spring 57 is provided, which via an intermediate ring 59 exerts a force, counteracting the first valve spring 45, on the armature 43.

The intermediate ring 59 is displaceable in the direction of the longitudinal axis of the armature 43 as far as a first stroke stop 61. In FIG. 2, a version is shown in which the intermediate ring 59 is centered by means of a recess 63 through the first stroke stop 61. The force with which the ball 41, in the operating state of the magnet valve 15 as shown, is pressed into the ball seat 47 is the difference between the forces of the first valve spring 45 and the second valve spring 57.

To trip a pre-injection, an electromagnet 49 of the magnet valve 15 is triggered with an attraction current $I_V$. The resultant force of the electromagnet 49 acting on the armature 43 is dimensioned such that it exceeds the difference between the forces, acting on the armature 43, of the first valve spring 45 and the second valve spring 57. Consequently the armature 43 moves in the direction of the electromagnet 49, until the intermediate ring 59 rests on the first stroke stop 61. As soon as the first stroke stop 61 absorbs the spring force of the second valve spring 57, the entire spring force of the first valve spring 45 acts counter to the force exerted on the armature 43 by the electromagnet 49. The spring force of the first valve spring is greater than the force of the electromagnet 49 when a current whose amount is expressed as $I_V$ flows through it. The armature 43 therefore opens in the pre-injection only until the intermediate ring 59 is in contact with the first stroke stop 61; this stroke corresponds to the distance designated by reference numeral 65 in FIG. 2. However, other stroke stop are also conceivable. For instance, the outward deflection of the second valve spring 57 can also be limited by means of a tie rod or the like that is connected to the second valve spring. The term "first stroke stop" is understood with regard to the present invention to mean that once a certain stroke of the armature 43 has been attained, the second valve spring 57 no longer acts upon the armature 43.

With the partial opening of the magnet valve 15, fuel can flow out of the valve control chamber 11, via the outflow conduit 12 and the outflow throttle 13 disposed in it, into a hollow chamber 51 located above the valve control chamber and via the fuel return 17 to the fuel tank, not shown, so that the pressure in the valve control chamber 11 drops. The inlet throttle 9 prevents a complete pressure equalization between the inlet conduit 5 shown in FIG. 1 and the valve control chamber 11. As soon as the hydraulic force, because of the dropping pressure in the valve control chamber 11, acting on the end face 33 of the valve piston 19 is less than the hydraulic force acting on the cross-sectional change 23, which is shown in FIG. 1 and is acted upon by the injection pressure, the nozzle needle 21 opens, and the injection begins.

The opening speed of the nozzle needle 21 shown in FIG. 1 is determined by the difference in flow between the inlet throttle 9 and the outflow throttle 13. Both the outflow throttle 13 and the ball seat 47 and ball 41 are flow resistors connected in series. In the pre-injection, because of the short stroke 65 of the armature 43, the flow resistance of the ball seat 47 and ball 41 is great. The opening speed of the nozzle needle 21 in the pre-injection is therefore relatively low. This makes it easier to meter small pre-injection quantities.

The main injection is tripped by the triggering of the electromagnet 49 of the magnet valve 15 with the so-called attraction current $I_A$, which is greater than $I_V$. In this case, the force of the electromagnet 49 acting on the armature 43 exceeds the force of the first valve spring 45 acting on the armature 43, and thus the armature 43 opens until a second stroke stop 67 is reached. In the opening of the magnet valve 15, the following relationships have a favorable effect:

If the magnet valve 15 is closed, the spacing between the armature 43 and the electromagnet 49 is great. The force of the electromagnet 49 acting on the armature 43 is therefore relatively slight. In this position, only the difference in the forces of the first valve spring 45 and the second valve spring 57 on the armature 43 is operative. In other words, at the onset of opening of the magnet valve 15, besides the forces of friction and inertia, only a slight spring force has to be overcome. An attraction current $I_V$ therefore suffices to achieve a partial opening of the magnet valve 15 and thus a slow opening of the nozzle needle 21.

If the magnet valve is already partly or even entirely opened, the spacing between the armature 43 and the electromagnet 49 is slight. Because the air gap between the armature 43 and the electromagnet 49 is now smaller, the force of the electromagnet 49 acting on the armature 43, for the same flow of current through the electromagnet 49, is relatively great. In this case, the electromagnet 49 can also overcome the force of the first valve spring 45. A reinforcement factor is that by this stage of the opening of the magnet valve 15, the forces of inertia of the armature 43 have already decreased.

In the main injection, a greater attraction current $I_A$ flows through the electromagnet 49, which results in a faster, wider opening of the magnet valve 15 and consequently of the nozzle needle 21 as well. The opening speed of the nozzle needle 21 in the main injection is high, since the armature 43 executes a long stroke, and the flow resistance of the ball seat 47 and the ball 41 is therefore very much less than in the pre-injection. If the injection nozzle 7 is fully open, the fuel 3 is injected into the combustion chamber at a pressure that is virtually equivalent to the pressure in the rail.

After a certain length of time, the increased attraction current $I_A$ is reduced to a lower maintenance current $I_H$. This is possible since the air gap of the magnetic circuit is now smaller.

As soon as the maintenance current $I_H$ is no longer flowing, the armature 43 is pressed in the direction of the ball 41 by the force of the first valve spring 45, and the ball 41 closes the outflow throttle 13. As soon as the stroke 65 is undershot, the second valve spring 57 brakes the armature 43, and prevents major wear of the ball seat 47 and the ball 41.

As a result of the closure of the outflow throttle 13, the rail pressure builds up again in the valve control chamber 11, via the inlet throttle 9. This pressure, via the end face 33 of the valve piston 19, exerts an increased hydraulic force on the valve piston 19 compared with the opened state. As soon as this hydraulic force and the force of the nozzle spring 39 exceed the hydraulic force acting on the cross-sectional change 23, the nozzle needle 21 closes.

The closing speed of the nozzle needle 21 is determined by the flow through the inlet throttle 9. The injection ends when the nozzle needle 21 is resting on the nozzle needle seat 35.

Figure 3A:
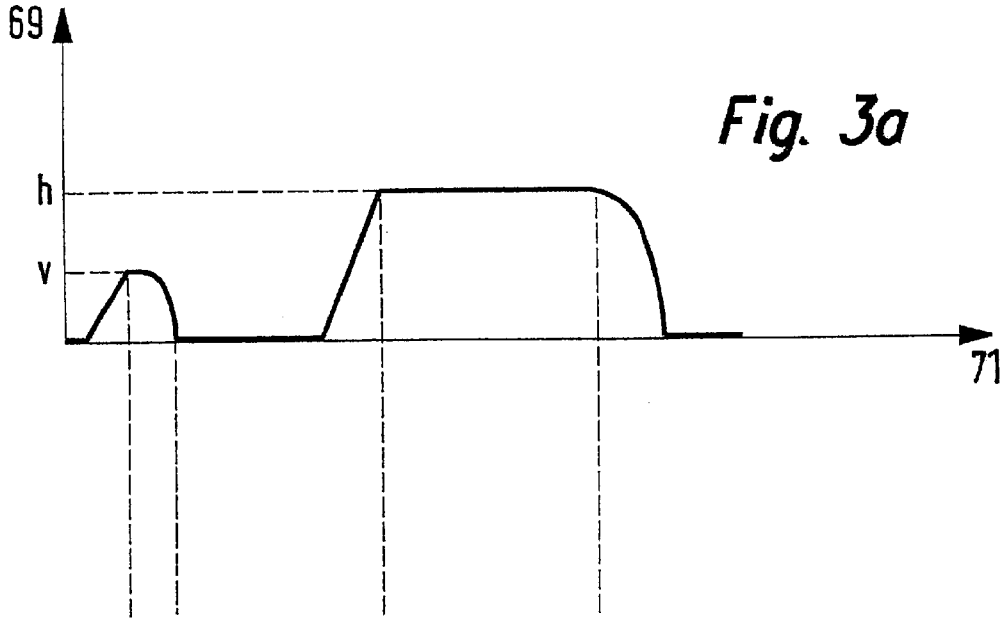
FIG. 3 shows timing graphs for the magnet valve.

In FIG. 3, the course over time of the actuation of the magnet valve and of the injection nozzle is shown in qualitative form. In FIG. 3*a*, the armature stroke 69 of the magnet valve is shown over time 71. On the ordinate, the armature stroke in the pre-injection is marked "v", and the armature stroke in the main injection is marked "h". It can be seen from a comparison of the slopes that the opening speed of the magnet valve is greater in the main injection than in the pre-injection. This can be attained for instance by means of a greater armature current in comparison with the pre-injection.

Figure 3B:
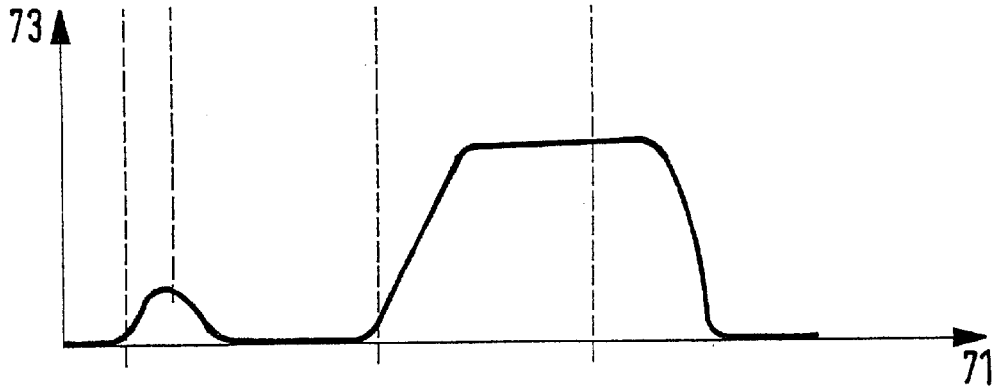

In FIG. 3*b*, the stroke of the injection nozzle 73 is shown over time 71. The perpendicular dashed lines are an attempt at illustrating the time lag between the initation of the actuation of the magnet valve and the opening or closure of the injection nozzle.

The foregoing relates to preferred exemplary embodiment of the invention, it being understood that other variants and embodiments thereof are possible within the spirit and scope of the invention, the latter being defined by the appended claims.

What is claimed is:

1. In an injector for an injection system for internal combustion engines, having a magnet valve (15) which controls the outflow of fuel (3) from a valve control chamber (11) through an outflow conduit (12), in which the magnet valve (15) has means (41, 47) for closing the outflow conduit (12), an armature (43) that is actuatable by an electromagnet (49) and is operatively connected to the means (41, 47) for closing the outflow conduit (12), a first valve spring (45) and a second valve spring (57) and a first stroke stop (61), the improvement wherein the first valve spring (45) urges the armature (43) in the closing direction with a greater spring force, and from the closing position of the magnet valve (15) until the first stroke stop (61) is reached, the second valve spring (57) urges the armature (43) in the opening direction with a lesser spring forces, wherein the travel of the armature (43) is limited by a second stroke stop (67).

2. The injector of claim 1, wherein the first valve spring (45) is a compression spring fastened between a housing (29) of the injector and the end of the armature (43) remote from the means (41, 47) for closing the outflow conduit (12), and the second valve spring (57) is a compression spring fastened between the housing (29) of the injector and the end of the armature (43) toward the means (41, 47) for closing the outflow conduit (12).

3. The injector of claim 2, wherein the means (41, 47) for closing the outflow conduit (12) are operatively connected to the armature (43) via a thrust rod (44).

4. The injector of claim 2, herein the means (41, 47) for closing the outflow conduit (12) are a ball (41) and a ball seat (47) in the housing (29).

5. The injector of claim 2, wherein the means for closing the outflow conduit (12) are a valve head, disposed on the end of the thrust rod (44) remote from the armature (43), and a complementary valve seat in the housing (29).

6. An injection system which includes the injector of claim 2, wherein the injection system is a common rail injection system.

7. The injector of claim 1, wherein the means (41, 47) for closing the outflow conduit (12) are operatively connected to the armature (43) via a thrust rod (44).

8. The injector of claim 7, wherein the second valve spring (57) and/or the intermediate ring (59) is disposed concentrically with the thrust rod (44).

9. The injector of claim 1, wherein the means (41, 47) for closing the outflow conduit (12) are a ball (41) and a ball seat (47) in the housing (29).

10. The injector of claim 1, wherein the means for closing the outflow conduit (12) are a valve head, disposed on the end of the thrust rod (44) remote from the armature (43), and a complementary valve seat in the housing (29).

11. An injection system which includes the injector of claim 1, wherein the injection system is a common rail injection system.

12. In an injector for an injection system for internal combustion engines, having a magnet valve (15) which controls the outflow of fuel (3) from a valve control chamber (11) through an outflow conduit (12), in which the magnet valve (15) has means (41, 47) for closing the outflow conduit (12), an armature (43) that is actuatable by an electromagnet (49) and is operatively connected to the means (41, 47) for closing the outflow conduit (12), a first valve spring (45) and a second valve spring (57) and a first stroke stop (61), the improvement wherein the first valve spring (45) urges the armature (43) in the closing direction with a greater spring force, and from the closing position of the magnet valve (15) until the first stroke stop (61) is reached, the second valve spring (57) urges the armature (43) in the opening direction with a lesser spring force, wherein the second valve spring (57) acts upon the armature (43) via a displaceable intermediate ring (59), and that the travel of the intermediate ring (59) is limited by the first stroke stop (61).

13. The injector of claim 12, wherein the travel of the armature (43) is limited by a second stroke stop (67).

14. The injector of claim 13, wherein the means (41, 47) for closing the outflow conduit (12) are operatively connected to the armature (43) via a thrust rod (44).

15. The injector of claim 14, wherein the second valve spring (57) and/or the intermediate ring (59) is disposed concentrically with the thrust rod (44).

16. The injector of claim 12, wherein the means (41, 47) for closing the outflow conduit (12) are operatively connected to the armature (43) via a thrust rod (44).

17. The injector of claim 12, wherein the means (41, 47) for closing the outflow conduit (12) are a ball (41) and a ball seat (47) in the housing (29).

* * * * *